US009444164B2

(12) United States Patent
Bean et al.

(10) Patent No.: US 9,444,164 B2
(45) **Date of Patent: *Sep. 13, 2016**

(54) WIRE TO BOARD TERMINAL

(71) Applicant: Molex, LLC, Lisle, IL (US)

(72) Inventors: Michael Bean, Elburn, IL (US); Blake Anderson, Lincoln, NE (US); Jeremy Leiting, Valparaiso, NE (US)

(73) Assignee: Molex, LLC, Lisle, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/132,370

(22) Filed: Apr. 19, 2016

(65) Prior Publication Data

US 2016/0233599 A1 Aug. 11, 2016

Related U.S. Application Data

(63) Continuation of application No. 14/443,682, filed as application No. PCT/US2013/072012 on Nov. 26, 2013, now Pat. No. 9,362,630.

(60) Provisional application No. 61/730,385, filed on Nov. 27, 2012, provisional application No. 61/825,666, filed on May 21, 2013.

(51) Int. Cl.

| | |
|---|---|
| ***H01R 12/00*** | (2006.01) |
| ***H01R 12/75*** | (2011.01) |
| ***H01R 4/18*** | (2006.01) |
| ***H01R 12/70*** | (2011.01) |

(52) U.S. Cl.

CPC ..... *H01R 12/75* (2013.01); *H01R 4/185* (2013.01); *H01R 12/7082* (2013.01)

(58) Field of Classification Search

CPC ..... H01R 4/18; H01R 4/23; H01R 13/41; H01R 9/09

USPC ..... 439/872, 751, 82, 63, 867

See application file for complete search history.

(56) References Cited

U.S. PATENT DOCUMENTS

| | | | | |
|---|---|---|---|---|
| 5,374,204 | A | 12/1994 | Foley et al. | |
| 5,772,454 | A * | 6/1998 | Long, Jr. | H01R 4/028 439/83 |
| 7,413,484 | B2 * | 8/2008 | Fedder | H01R 12/585 439/751 |
| 2002/0177372 | A1 | 11/2002 | Hwang | |
| 2007/0123083 | A1 | 5/2007 | Kreuter | |
| 2008/0166928 | A1 * | 7/2008 | Tang | H01R 12/585 439/751 |
| 2015/0288081 | A1 * | 10/2015 | Bean | H01R 4/185 439/82 |

FOREIGN PATENT DOCUMENTS

| | | | |
|---|---|---|---|
| KR | 10-2010-0011827 | A | 2/2010 |
| TW | M356307 | U | 5/2009 |

* cited by examiner

*Primary Examiner* — Abdullah Riyami
*Assistant Examiner* — Nader Alhawamdeh
(74) *Attorney, Agent, or Firm* — James A. O'Malley

(57) ABSTRACT

A terminal includes two crimp sections, one that engages a bare conductor and one that engages an insulated conductor. The terminal includes two legs that are configured to be located in apertures in a support circuit board. Thus a wire can be electrically connected to the circuit board in a low-profile manner.

19 Claims, 9 Drawing Sheets

WIRE TO BOARD TERMINAL

RELATED APPLICATIONS

This application claims priority to U.S. patent application Ser. No. 14/443,682, filed May 19, 2015, which is a national phase of International Patent Application No. PCT/US2013/072012, filed Nov. 26, 2013, which, in turn, claims priority to each of U.S. Provisional Application No. 61/730,385, filed Nov. 27, 2012 and U.S. Provisional Application No. 61/825,666, filed May 21, 2013. All of the foregoing applications are incorporated herein by reference in their entirety.

FIELD OF THE INVENTION

The present invention relates to the field of terminals, more specifically to the field of terminals that can be mounted on a circuit board.

DESCRIPTION OF RELATED ART

Terminals have been provided for connecting to circuit boards. The designs can be configured to be soldered or press-fit into vias provided in the board. For applications where robustness has greater value, the designs tend to be focused more on terminal designs that can be soldered to the circuit board. Two basic designs are possible, one that is provided with a housing, and one that is provided without a housing. A housing provides a number of benefits but tends to be more costly. Consequentially, certain applications might be better served by a terminal-only design. Existing designs, however, tend to not provide a low profile. Thus, certain individuals would appreciate further improvements to terminal design and wire to board connectors.

BRIEF SUMMARY

A terminal is disclosed that can be secured to wire that is composed of an insulation layer wrapped around a conductor and the terminal includes a first crimp portion and a second crimp portion. The first crimp portion is configured to engage the insulation layer and the conductor. The second crimp portion is configured to engage the conductor with the insulation layer removed. The first and second crimps can each include a pair of wings that are folded toward each other so that, when the terminal is secured to the wire, the wings securely grip the corresponding regions of the wire. Two legs are positioned between the first and second crimp portions with individual legs positioned on opposite sides of the terminal or both legs positioned on the same side of the terminal. The legs are configured to be soldered to a circuit board and include tails that can be configured with eye-of-the-needle construction or any other convention tail construction that is desirable for soldering to the circuit board. Thus, a wire can be electrically connected to the circuit board in a low-profile manner.

BRIEF DESCRIPTION OF THE DRAWINGS

The present invention is illustrated by way of example and not limited in the accompanying figures in which like reference numerals indicate similar elements and in which.

DETAILED DESCRIPTION

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

Figure 1:
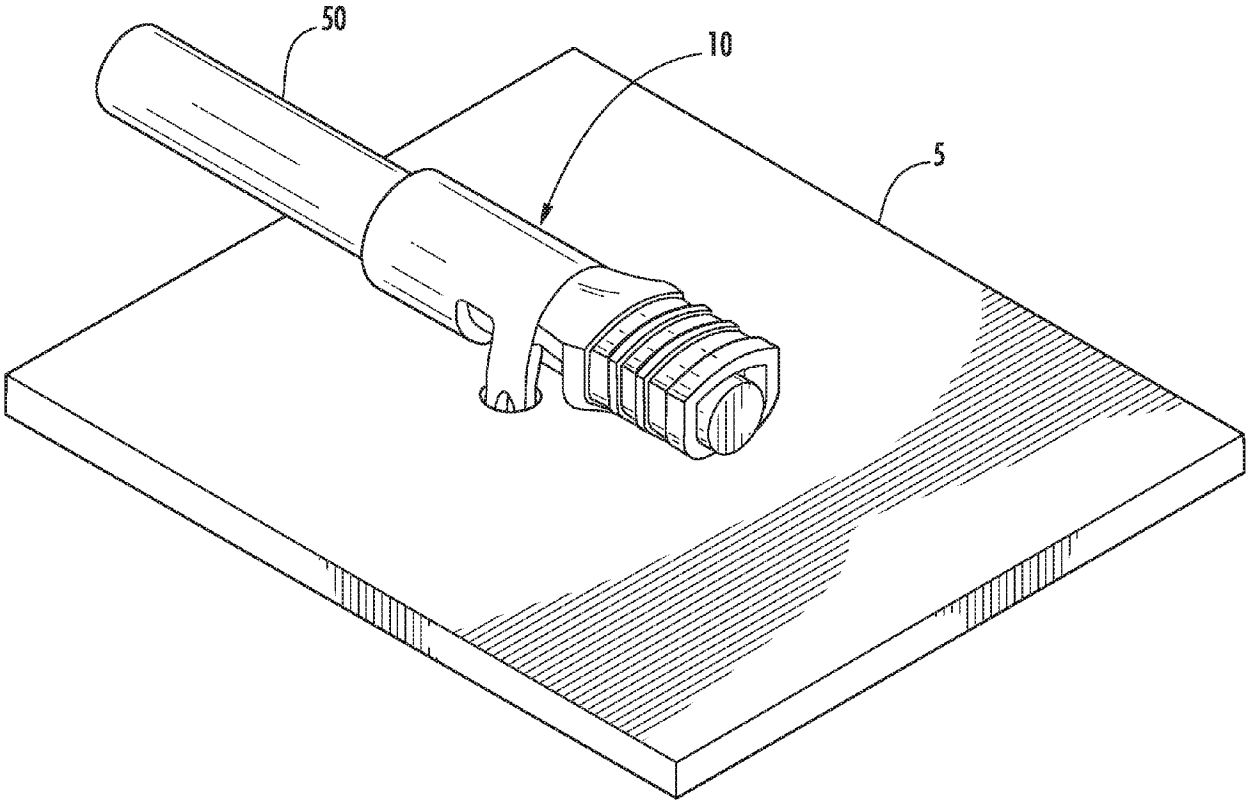
FIG. 1 is a perspective view of an embodiment of a terminal assembly.
Figure 2:
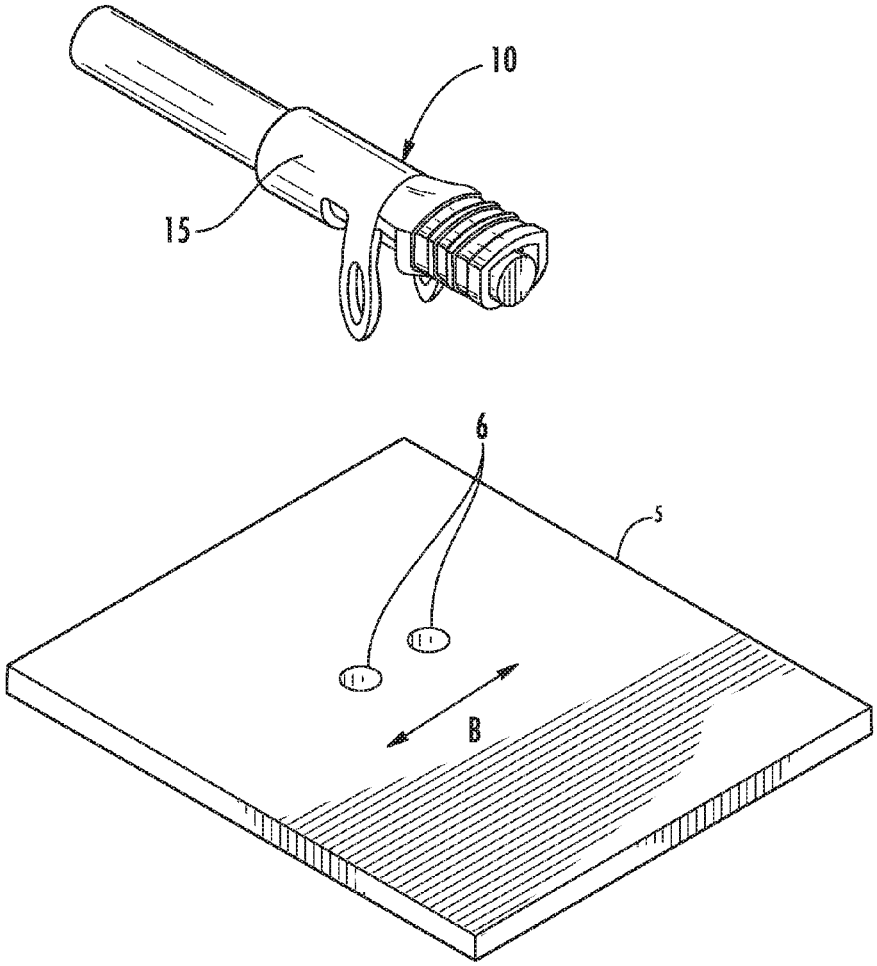
FIG. 2 is a perspective view of the crimped terminal depicted in FIG. 1 with the crimped terminal separated from a circuit board.
Figure 3:
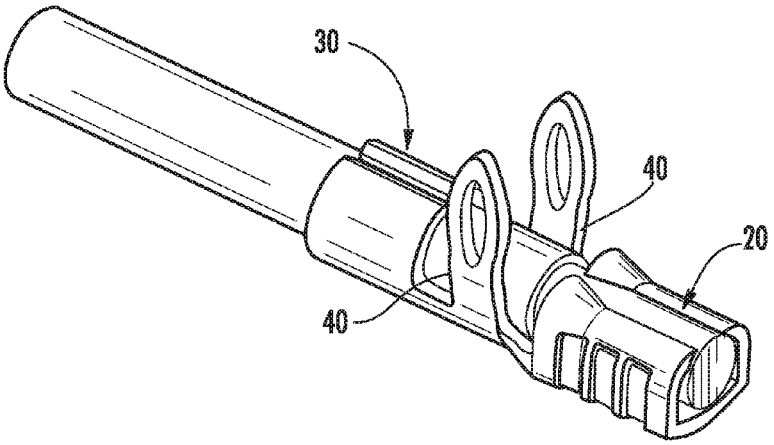
FIG. 3 is a perspective view of the crimped terminal of FIG. 2.
Figure 4:
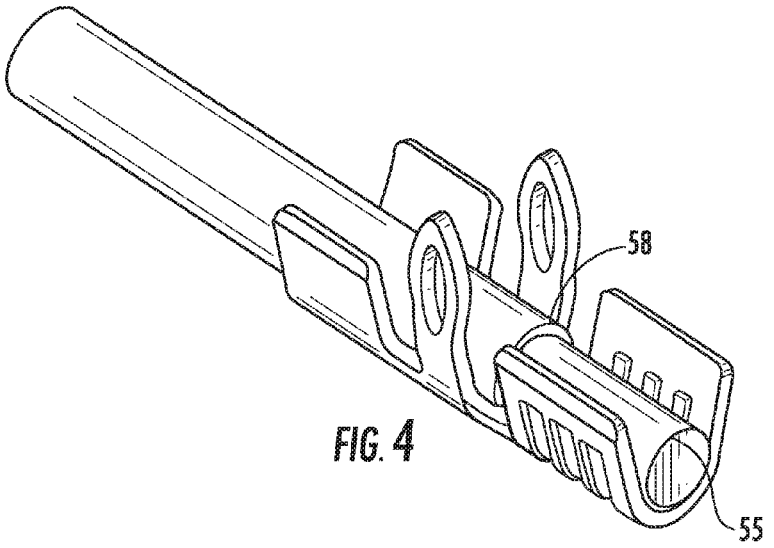
FIG. 4 is a perspective view of the un-crimped terminal of FIG. 3.

The terminal includes a variety of benefits, as can be appreciated from the attached figures. As shown in FIGS. 1 and 2 a terminal 10 is configured to be mounted to circuit board 5 that includes apertures 6 and supports a wire 50 that includes a conductor 55 and an insulation layer 58. As further illustrated in FIGS. 3 and 4 the terminal includes a first crimp 20 on a base 15 and a second crimp 30 that act to secure the wire and terminal together. The first crimp 20 includes wings 22*a*, 22*b* and the second crimp 30 includes wings 32*a*, 32*b* that are respectively folded toward each other so as to securely grip the wire 50.

Figure 5:
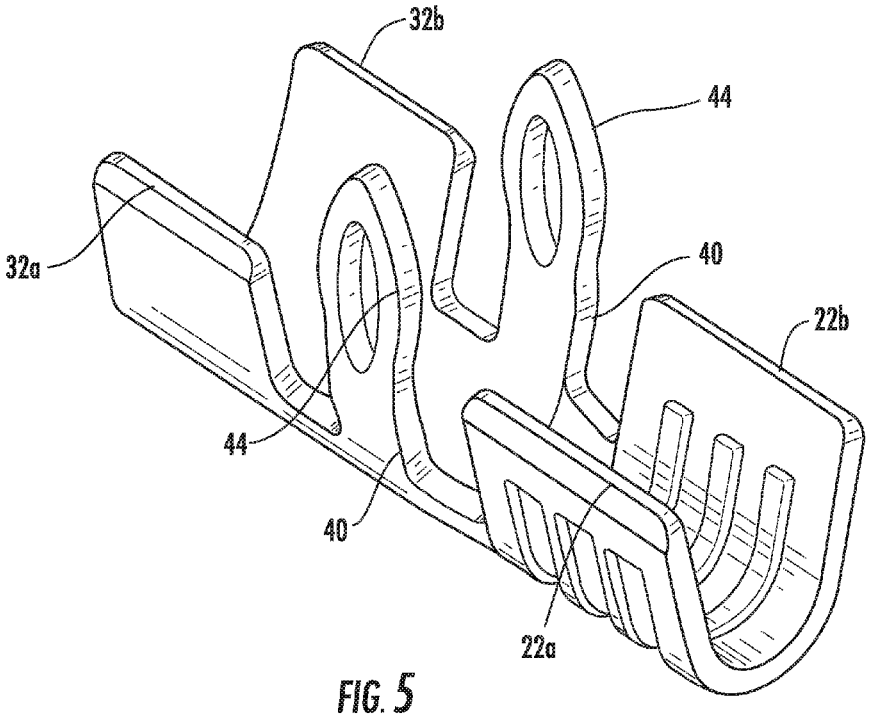
FIG. 5 is a perspective view of the terminal.
Figure 6A:
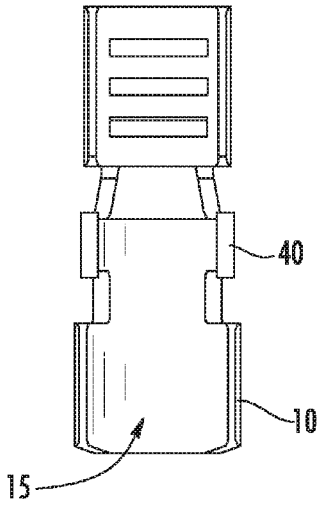
FIG. 6*a* is a plan view of the terminal of FIG. 5.
Figure 6B:
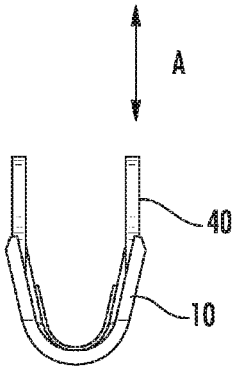
FIG. 6*b* is a side view of the terminal of FIG. 5.
Figure 6C:
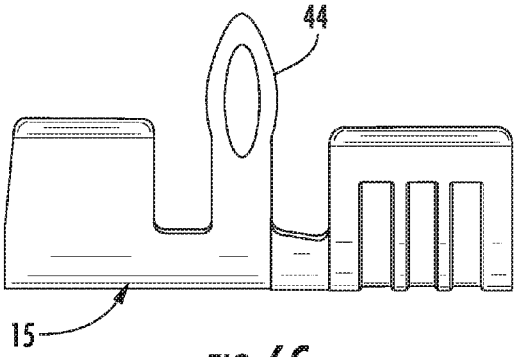
FIG. 6*c* is a front view of the terminal of FIG. 5.

As best shown in FIG. 5 a pair of legs 40 is positioned between the first crimp 20 and the second crimp 30. Each leg 40 includes a tail 44. The tail 44 is depicted as having an eye-of-the-needle design but could also be a simple through-hole design if desired. The benefit of the eye-of-the-needle design is that the terminal 10 can be more securely positioned on the circuit board 5 prior to a reflow operation. However, compared to conventional eye-of-the-needle designs the depicted embodiment can be configured so that it is retained in the plated through hole but with less of an interference fit than an eye-of-the-needle design used to provide a press-fit construction. For example, typical press-fit construction is designed so that the terminal tail width is at least 15% greater than the diameter of the mating via (and preferably at least 20% greater). In contrast, the depicted design will have a tail width that is designed for an interference fit but the interference fit is reduced as the tail width is less than 15% larger than the diameter of the plated through hole, typically less than 12% larger and potentially less than 11% larger. It has also been determined that in addition to the retention force, the opening in the tail helps provide a better electrical connection between tail and the via due to the improved solder connection and increased surface area, thus the depicted design helps reduce resistance and improving the performance of the connector system.

One benefit of the design is that the crimp 30 engages the insulation layer, which provides additional structural benefits as the combination of the insulation layer 58 and the conductor 55 is stronger than the conductor 55 by itself. Another benefit of the depicted design is that the two legs 40 engage the circuit board 5 between the first crimp 20 and the second crimp 30, thus helping to ensure external forces applied to the wire do not materially impact the first crimp 20 (thus helping to protect the electrical connection between the wire and the terminal). The balanced construction of the two tails 40 on opposite sides of the base 15 further helps distribute forces to the circuit board, which is expected in practice to help protect the connection between the terminal 10 and the supporting circuit board 5. In an embodiment, the terminal 10 can be configured so that the second crimp 30 is seated directly on the circuit board 5 while the first crimp 20 is positioned slightly above the circuit board 5.

As can be appreciated the legs 40 have tails 44 that extend in a direction A that is substantially perpendicular to a direction B, defined by the surface of the circuit board as illustrated in FIG. 2 and FIGS. 6*a*-6*c*. To put it another way, the tail 44 can be perpendicular or even orthogonal to the circuit board 5. As depicted, the tail 44 extends through the supporting circuit board 5. This allows for a solder fillet to form on the opposite side of the board when the terminal 10 is soldered to the circuit board 5, thus increasing retention force.

It should be noted that the base 15 can be configured so that the second crimp 30 is positioned directly on the circuit board while the first crimp 20 is elevated with respect to the board. Using the circuit board 5 to provide further support for the terminal 10 is expected to help further ensure the terminal 10 is not inadvertently removed from the circuit board 5. Thus, the base 15 can provide a level from which the first and second crimps extend, however the larger size of the second crimp 30, along with the depicted orientation of the legs 40, will cause it contact a supporting circuit board first and will help provide additional support for the terminal. Thus, the depicted embodiment allows a wire to be electrically connected to a supporting circuit board in a low-profile manner.

Figure 9:
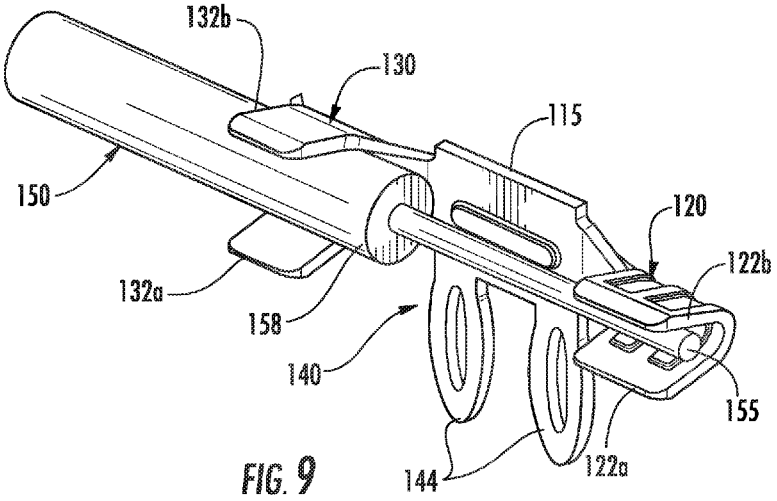
FIG. 9 is a perspective view of the un-crimped terminal of FIG. 8.
Figure 10:
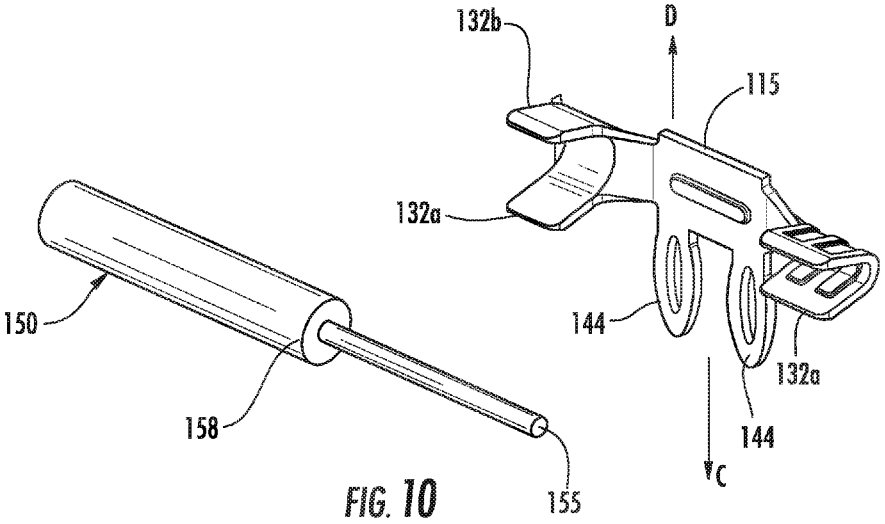
FIG. 10 is an exploded perspective view of the terminal of FIG. 8.

FIGS. 9 and 10 show another arrangement, the legs 140 are formed between the first 120 and second 130 crimps and both legs 140 extend from the same side of the base 115 in a direction C. The base 115 can be formed as a flat plate with a first surface and both crimps can be formed and supported such that they are positioned a distance away from the first surface. In this arrangement the terminal 110 is rotated 90 degrees with the legs 140 lying on the same plane as the base 115 of the terminal 110. Similarly the legs 140 have tails 144 that are received in plated holes 106 formed in the circuit board 105 in a perpendicular or orthogonal manner. Additionally, the first crimp 120 includes wings 122*a*, 122*b* and the second crimp includes wings 132*a*, 132*b* that are respectively folded toward each other so as to securely grip the wire 150.

Figure 7:
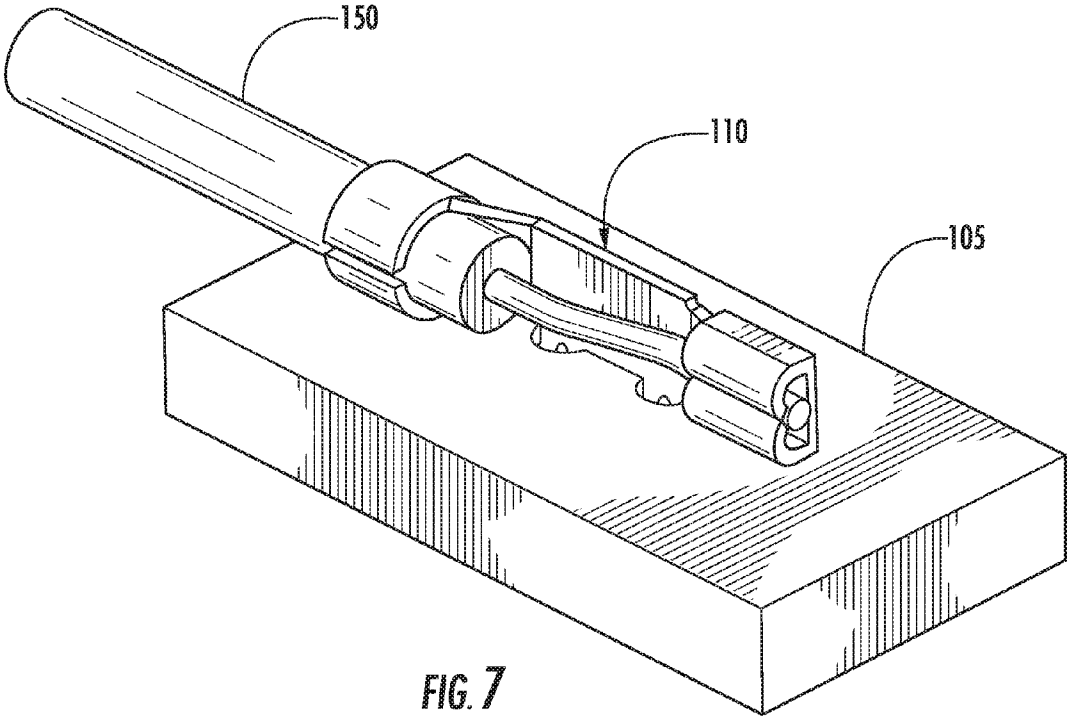
FIG. 7 is perspective view of a second embodiment of a terminal assembly.
Figure 8:
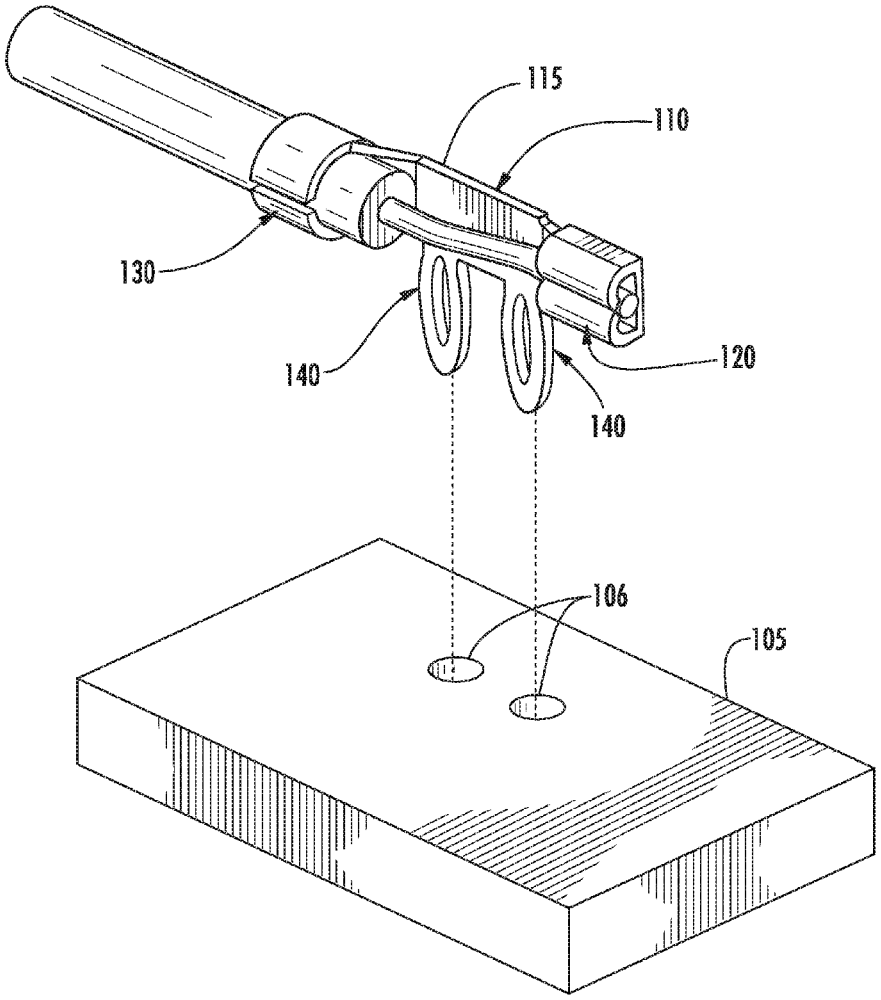
FIG. 8 is a perspective view of the crimped terminal depicted in FIG. 7 with the crimped terminal separated from a circuit board.

Essentially, as depicted in FIGS. 7 and 8 the terminal 110 is positioned on its side with the first crimp 120 engaging the conductor 155 of the wire 150 and the second crimp 130 engaging the insulating layer 158 surrounding the conductor 155 of the wire 150 with the first crimp 120 positioned slightly above the circuit board 105 and the second crimp 130 positioned directly on and also supported by the circuit board 105. In this configuration, the legs 140 have tails 144 that are formed with an eye-of-the-needle design configured to be pressed into the plated hole 106 in the circuit board 105 and soldered (as discussed above). The tails could also be provided in a through hole configuration in which the tails are soldered to contact pads disposed on the opposite side of the circuit board. As can be appreciated, both legs 140 extend from the same side of a base 115.

Figure 11:
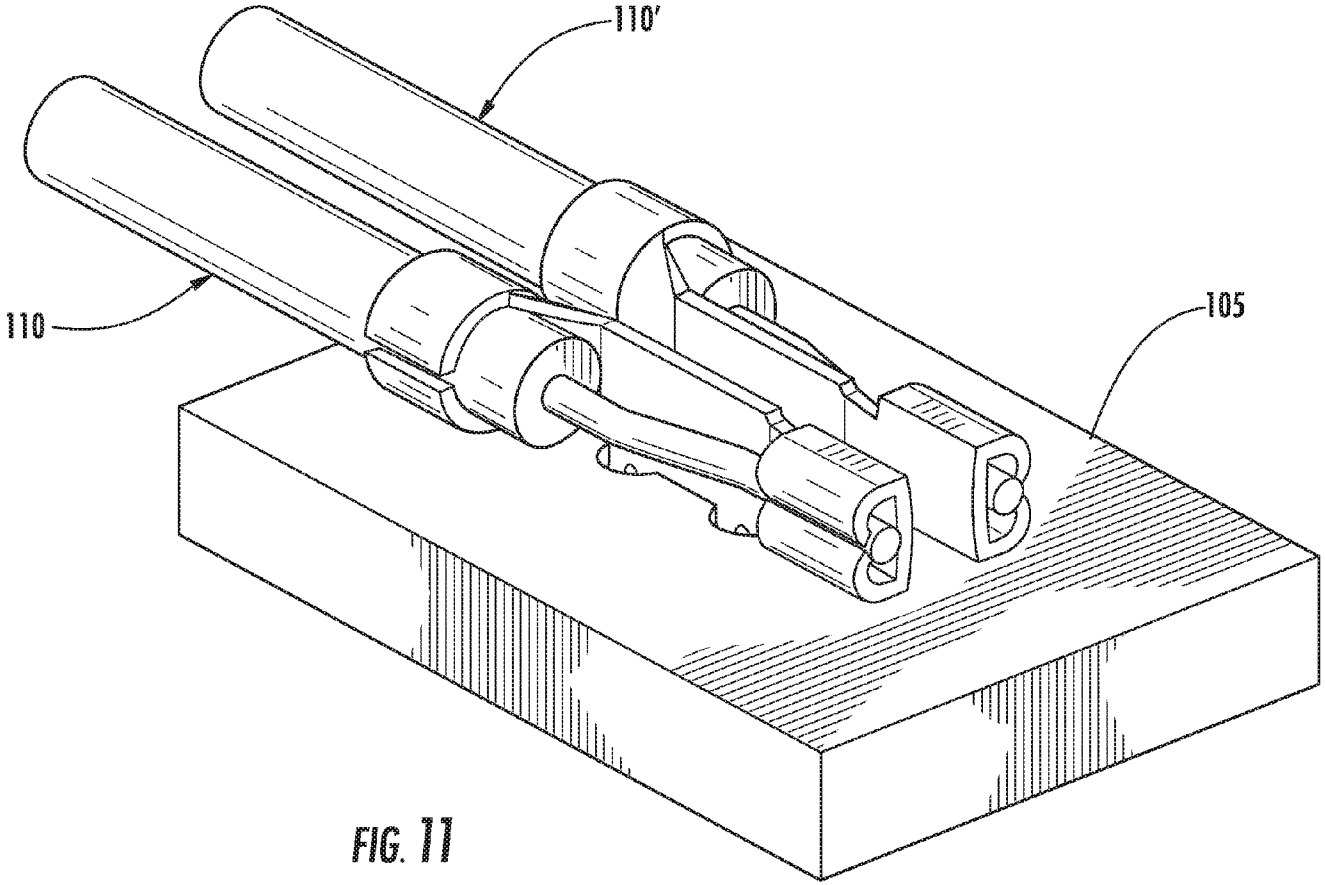
FIG. 11 is a perspective view of an embodiment of the terminal assembly.

As previous stated, the terminal 110 provides a low profile arrangement to minimize the height the terminal 110 extending from the circuit board. As depicted, the terminal maintains a low profile configuration, and also when in operation, upon mounting to a circuit board maintains a close spacing between terminals when arranged in a side-by-side array. As best shown in FIG. 10, it can be appreciated that both the legs 140 extend in a direction C from the base 115 of the terminal 110, allowing the lead wire 150 to extend away from the terminal 110 in a first direction. In another configuration the legs 140 may also extend in a direction D on the opposite side of the base 115 of the terminal 110 essentially creating a flipped or mirrored version of the terminal. The mirrored version allows the lead wire 150 to extend in the first direction while mirroring the position of the crimps with respect to the base. With this configuration, as depicted in FIG. 11, adjacent terminals can be disposed on a circuit board in a back-to-back arrangement in close proximity further minimizing terminal spacing. Thus, an embodiment can include a first wire assembly and a second wire assembly, the wire assemblies configured to be mated to a circuit board in a back-to-back orientation and the terminals are configured so that the first and second legs extend from the same side of the base in both configurations.

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

We claim:

1. A terminal, the terminal comprising:

a base having first and second opposite ends;

a first crimp portion which extends outwardly from the base proximate to the first end thereof, the first crimp portion being configured to be crimped to an exposed conductor of a wire;

a second crimp portion which extends outwardly from the base proximate to the second end thereof, the second crimp portion being configured to be crimped to an insulation layer of the wire; and first and second legs which extend outwardly from the base, the first leg being configured to extend into a corresponding first aperture of a circuit board, the second leg being configured to extend into a corresponding second aperture of the circuit board.

2. The terminal according to claim 1, wherein each leg includes a tail, the tail of each leg having an eye-of-the-needle design such that the tail is configured to be press-fit into the corresponding aperture of the circuit board.

3. The terminal according to claim 1, wherein the first crimp portion is formed of first and second wings which are configured to extend and fold around opposite sides of the exposed conductor of the wire.

4. The terminal according to claim 1, wherein the second crimp portion is formed of first and second wings which are configured to extend and fold around opposite sides of the insulation layer of the wire.

5. The terminal according to claim 1, wherein the first and second legs extend outwardly from the base between where the first and second crimp portions extend outwardly from the base.

6. The terminal according to claim 1, wherein the base has first and second opposite sides, and wherein the first leg extends outwardly from the first side of the base, and wherein the second leg extends outwardly from the second side of the base, wherein each of the first and second crimp portions and the first and second legs extend outwardly from the base in a generally perpendicular manner.

7. The terminal according to claim 1, wherein the base has a side, and wherein each of the first and second legs extend outwardly from the side of the base, wherein each of the first and second crimp portions extend outwardly from the base in a generally perpendicular manner, and wherein each of the first and second legs extend outwardly from the base in a generally planar manner.

8. A wire assembly, the wire assembly comprising:

a wire having an insulation layer that covers a conductor, the wire having first and second portions, the first portion being formed of the insulation layer and the conductor, the second portion being formed of only the conductor; and a terminal, the terminal having a base, first and second crimp portions, and first and second legs, the base having first and second opposite ends, the first crimp portion extending outwardly from the base proximate to the first end thereof, the first crimp portion being crimped to the second portion of the wire, the second crimp portion extending outwardly from the base proximate to the second end thereof, the second crimp portion being crimped to the first portion of the wire, the first and second legs extending outwardly from the base, the first leg being configured to extend into a corresponding first aperture of a circuit board, the second leg being configured to extend into a corresponding second aperture of the circuit board.

9. The wire assembly according to claim 8, wherein each leg includes a tail, the tail of each leg having an eye-of-the-needle design such that the tail is configured to be press-fit into the corresponding at least one aperture of the circuit board.

10. The wire assembly according to claim 8, wherein the first crimp portion is formed of first and second wings which extend and fold around opposite sides of the second portion of the wire, wherein the second crimp portion is formed of first and second wings which extend and fold around opposite sides of the first portion of the wire.

11. The wire assembly according to claim 8, wherein the first and second legs extend outwardly from the base between where the first and second crimp portions extend outwardly from the base.

12. The wire assembly according to claim 8, wherein the base has first and second opposite sides, and wherein the first leg extends outwardly from the first side of the base, and wherein the second leg extends outwardly from the second side of the base, wherein each of the first and second crimp portions and the first and second legs extend outwardly from the base in a generally perpendicular manner.

13. The wire assembly according to claim 8, wherein the base has a side, and wherein each of the first and second legs extend outwardly from the side of the base, wherein each of the first and second crimp portions extend outwardly from the base in a generally perpendicular manner, and wherein each of the first and second legs extend outwardly from the base in a generally planar manner.

14. An assembly, the assembly comprising:

a circuit board, the circuit board having a support surface and first and second apertures; and a wire assembly, the wire assembly including a wire and a terminal, the wire having an insulation layer that covers a conductor, the wire having first and second portions, the first portion being formed of the insulation layer and the conductor, the second portion being formed of only the conductor, the terminal having a base, first and second crimp portions, and first and second legs, the base having first and second opposite ends, the first crimp portion extending outwardly from the base proximate to the first end thereof, the first crimp portion being crimped to the second portion of the wire, the first crimp portion being separated from the support surface of the circuit board, the second crimp portion extending outwardly from the base proximate to the second end thereof, the second crimp portion being crimped to the first portion of the wire, the second crimp portion being seated on the support surface of the circuit board, the first and second legs extending outwardly from the base, the first leg extending into the first aperture of the circuit board, the second leg extending into the second aperture of the circuit board.

15. The assembly according to claim 14, wherein each leg includes a tail, the tail of each leg having an eye-of-the-needle design such that the tail is configured to be press-fit into the at least one aperture of the circuit board.

16. The assembly according to claim 14, wherein the first crimp portion is formed of first and second wings which extend and fold around opposite sides of the second portion of the wire, wherein the second crimp portion is formed of first and second wings which extend and fold around opposite sides of the first portion of the wire.

17. The assembly according to claim 14, wherein the first and second legs extend outwardly from the base between where the first and second crimp portions extend outwardly from the base.

18. The assembly according to claim 14, wherein the base is generally parallel to the support surface of the circuit board, wherein the base has first and second opposite sides, and wherein the first leg extends outwardly from the first side of the base in a generally perpendicular manner toward the support surface of the circuit board, and wherein the second leg extends outwardly from the second side of the base in a generally perpendicular manner toward the support surface of the circuit board, wherein each of the first and second crimp portions extend outwardly from the base in a generally perpendicular manner toward the support surface of the circuit board.

19. The assembly according to claim 14, wherein the base is generally perpendicular to the support surface of the circuit board, the base having a side which faces the support surface of the circuit board, and wherein each of the first and second legs extend outwardly from the side of the base in a generally planar manner toward the support surface of the circuit board, wherein each of the first and second crimp portions extend outwardly from the base in a generally perpendicular manner such that the first and second crimp portions are general parallel to the support surface of the circuit board.

* * * * *